United States Patent [19]

Candland et al.

[11] Patent Number: 5,062,366

[45] Date of Patent: Nov. 5, 1991

[54] TEMPERATURE COMPENSATING CONTROL SYSTEM FOR ADJUSTING PRIMARY PROPELLANT CHAMBER VOLUME

[75] Inventors: Calvin T. Candland, Eden Prairie; Kim L. Christianson, Maple Grove; James L. Kennedy, Bloomington; David A. Smith, St. Paul; Francis J. Nosan, Brooklyn Park; Steven F. Overend, New Hope, all of Minn.

[73] Assignee: Honeywell Inc., Minneapolis, Minn.

[21] Appl. No.: 389,939

[22] Filed: Aug. 7, 1989

[51] Int. Cl.[5] ..... F42B 5/02

[52] U.S. Cl. ..... 102/430; 102/470

[58] Field of Search ..... 89/7; 102/470, 469, 102/430, 433, 434

[56] References Cited

U.S. PATENT DOCUMENTS

| | | | |
|---|---|---|---|
| 4,197,801 | 4/1980 | LaFever et al. | 102/433 |
| 4,335,657 | 6/1982 | Bains | 102/433 |
| 4,406,229 | 9/1983 | Greene et al. | 102/530 |
| 4,777,881 | 10/1988 | Candland et al. | 102/430 |
| 4,815,387 | 3/1989 | Lubbers | 102/470 |

FOREIGN PATENT DOCUMENTS

| | | | |
|---|---|---|---|
| 204539 | 12/1986 | European Pat. Off. | 102/430 |

*Primary Examiner*—Charles T. Jordan
*Assistant Examiner*—Stephen Johnson
*Attorney, Agent, or Firm*—Merchant, Gould, Smith, Edell, Welter & Schmidt

[57] ABSTRACT

A control system compensates for temperature dependent propellant burning characteristics by adjusting the chamber volume available to the propellant in an ammunition round. The control system includes a control tube housing, a piston assembly slidably mounted relative to the housing for movement through a drive stroke and being drivingly coupled to a trailing end of the projectile, and components responsive to the temperature of the round for adjusting the length of the drive stroke of the piston assembly in proportion to the temperature and thereby adjusting the position of the projectile and volume of the chamber in proportion to the temperature of the round.

23 Claims, 6 Drawing Sheets

Fig. 6
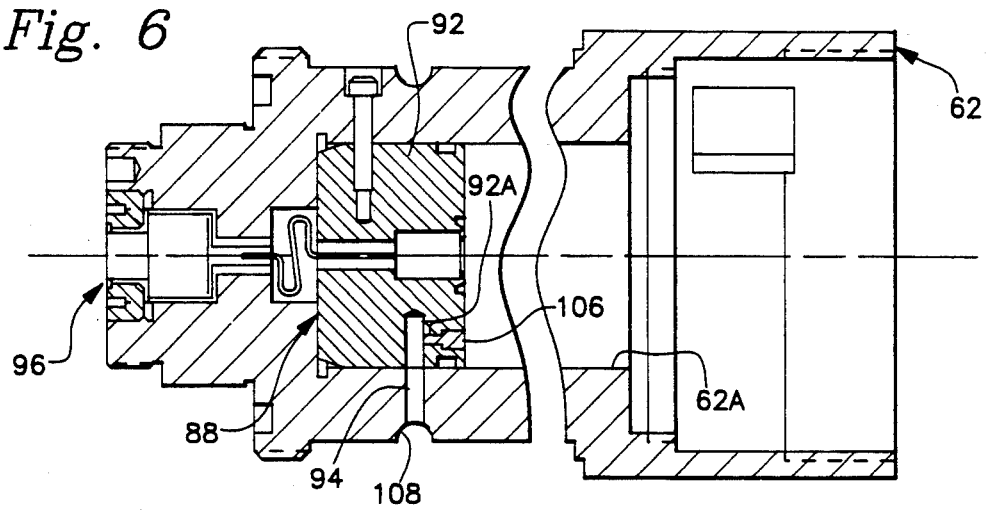
Fig. 7
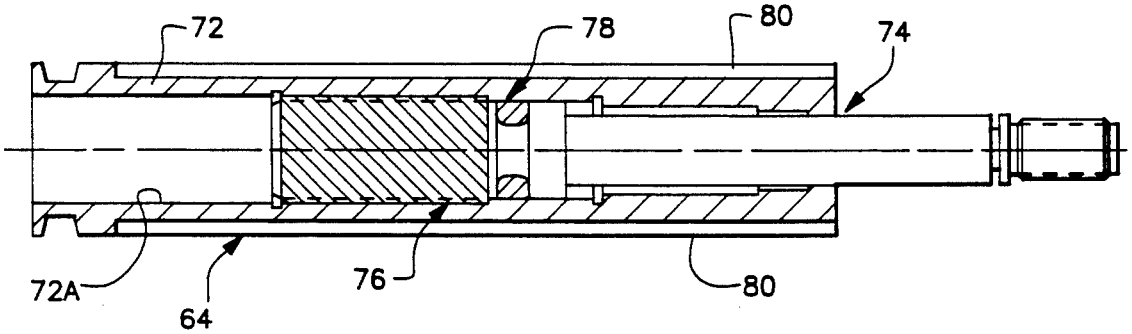
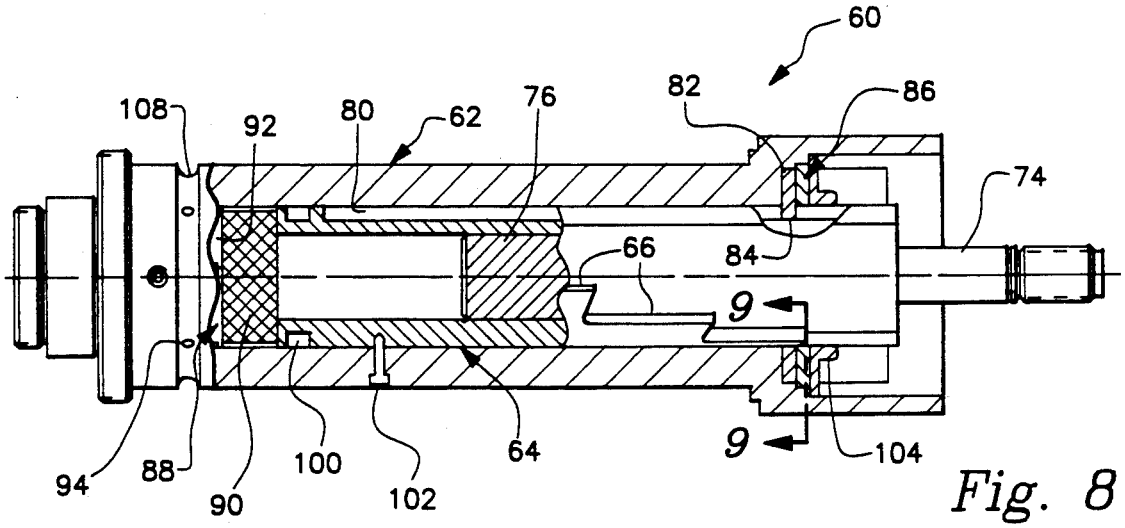
Fig. 8

TEMPERATURE COMPENSATING CONTROL SYSTEM FOR ADJUSTING PRIMARY PROPELLANT CHAMBER VOLUME

CROSS REFERENCE TO RELATED APPLICATION

Reference is hereby made to the following copending U.S. patent application dealing with related subject matter and assigned to the same assignee of the present invention:

"Temperature Compensating Variable Stroke Projectile Positioning System" by Calvin T. Candland, assigned U.S. Ser. No. 264,921 and filed Oct. 31, 1989.

BACKGROUND OF THE INVENTION

1. Field of the Invention

The present invention generally relates to munitions employing propellant with temperature dependent performance characteristics and, more particularly, is concerned with a temperature compensating control system for adjusting primary propellant chamber volume in a round of ammunition.

2. Description of the Prior Art

Projectile munitions have varied performance dependent on environmental temperatures. Propellants of the munitions typically provide high velocity performance under high ambient temperatures. However, under cold conditions such munitions provide low velocity performance due to the slower burn rate of propellants.

For reasons of safety of firing crews and of avoiding excessive stress on firing mechanisms, most munitions are designed to be safe at high ambient temperatures. Such a design results in low performance munitions at medium or low temperature climatic conditions.

One approach to temperature compensating control of projectile munitions propellants for improving munitions performance at all environmental temperatures, i.e., temperature independent performance, is disclosed in the patent application cross-referenced above (but is not considered to be prior art to the present invention). In the cross-referenced application, temperature compensation is achieved by use of a separate variable stroke drive ram system for loading and adjusting the position of the projectile and thereby the volume of the propellant chamber.

Although this approach constitutes steps in the right direction, other approaches still need to be explored in searching for ways to ensure optimal performance of projectile munitions at all environmental temperatures. The referenced application would require a major redesign of an existing gun system. This invention utilizes a concept that can potentially be applied to a broader range of new and existing gun and ammunition systems.

SUMMARY OF THE INVENTION

The present invention provides a temperature compensating control system designed to satisfy the aforementioned needs. The features of the control system of the present invention achieve temperature compensating adjustment of the location of a projectile and thereby adjustment of the main or primary propellant chamber volume in an ammunition round which employs a propellant having temperature dependent performance characteristics.

Accordingly, the present invention is directed to a temperature compensating control system for adjusting the volume of an ammunition round chamber communicating with a projectile and containing a propellant having temperature dependent performance characteristics. The control system comprises: (a) a control tube housing; (b) a piston assembly slidably mounted relative to the housing for movement through a drive stroke and being drivingly coupled to a trailing end of the projectile; and (c) means responsive to the temperature of the ammunition round for adjusting the length of the drive stroke of the piston assembly in proportion to the temperature and thereby adjusting the position of the projectile and volume of the chamber in proportion to the temperature of the ammunition round.

The piston assembly stroke length adjusting means includes a plurality of different stroke length defining stops formed on the piston assembly, an armature pivotally mounted to the housing for adjusting the stroke length of the piston assembly by being alignable with one of the different stops, and a bimetallic strip responsive to temperature variation by changing its geometry in proportion to the temperature variation of the ammunition round to cause pivoting of the armature into alignment with different ones of the piston stops for adjusting the piston assembly stroke length and thereby compensating for temperature variation.

Two alternative embodiments of the piston assembly are disclosed. Each embodiment of the piston assembly includes a piston slidably mounted relative to the housing for movement through the drive stroke and means connected to the projectile and mounted to the piston to move therewith for transmitting the driving energy of the piston to the projectile to move the same and for absorbing energy to stop movement of the projectile at the end of the drive stroke of the piston.

In the first embodiment, the piston is in the form of a hollow cylinder mounted about the exterior of the control tube housing for slidable movement therealong and having the different stroke length defining stops defined on the interior of the cylinder. The energy absorbing means is a hollow extension sleeve connected at a leading end of the piston and a connector rod releasably connected at a leading end to the projectile and slidably mounted at a trailing end in the sleeve and in abutting relation with the piston to move with the piston through its stroke.

In the second embodiment, the piston is in the form of a hollow cylinder mounted within the interior of the control tube housing for slidable movement therealong and having the different stroke length defining stops defined on the exterior of the cylinder. The energy absorbing means is a connector rod releasably connected at a leading end to the projectile and slidably mounted at a trailing end in the piston and in abutting relation therewith to move with the piston through its stroke.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the course of the following detailed description, reference will be made to the attached drawings in which:

FIG. 6 is an enlarged foreshorted longitudinal axial sectional view of a control tube housing of the control system of FIG. 5 assembled with the ignitor.

FIG. 7 is a longitudinal axial sectional view of a piston assembly of the control system of FIG. 5.

FIG. 8 is a side elevational view, partly broken away and axially sectioned, of the control tube housing and piston assembly of the control system of FIG. 5 assembled with the ignitor and secondary propellant.

DETAILED DESCRIPTION OF THE INVENTION

Figure 1:
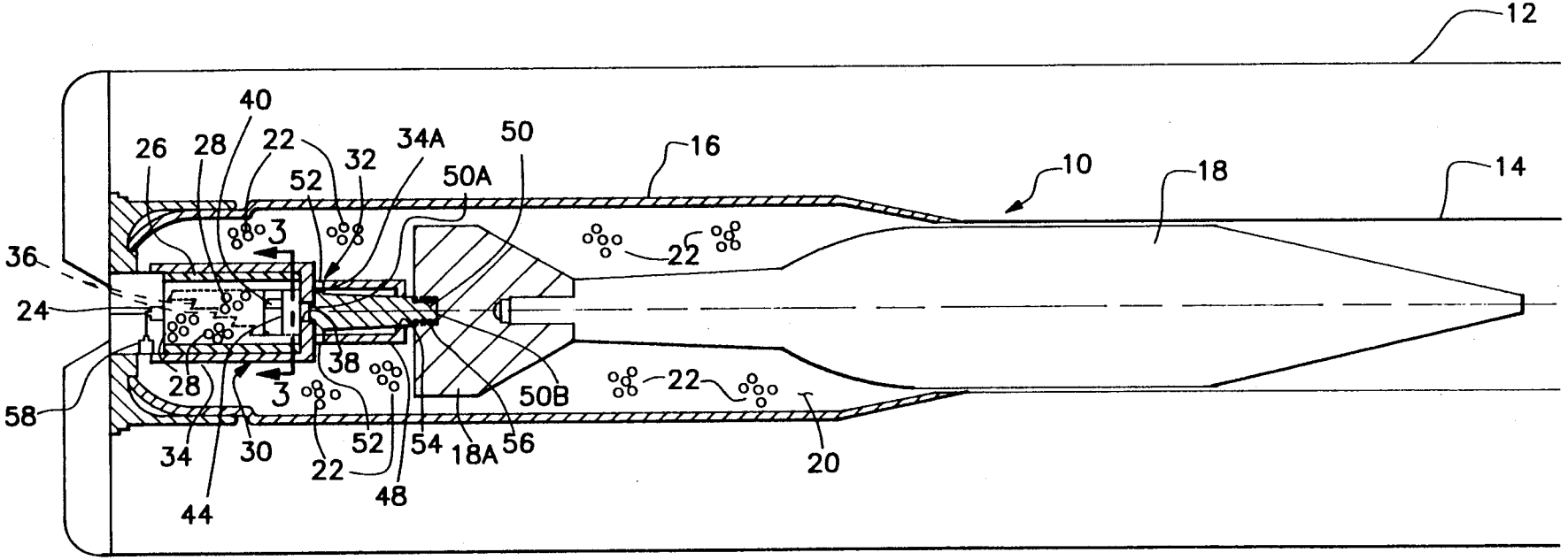
FIG. 1 is a longitudinal axial sectional view of a round of ammunition incorporating a first embodiment of the temperature compensating control system of the present invention and being illustrated in a firing chamber of a gun shown in fragmentary form.

Referring now to the drawings, and particularly to FIG. 1, there is shown an ammunition round 10, such as 120 millimeter ammunition, positioned in a cannon or gun 12 having a barrel 14 designed at one end to receive the case 16 of the ammunition round 10 so that a projectile 18 thereof partially disposed in the case 16 and projecting forwardly therefrom can be fired forwardly through the barrel 14.

In addition to holding the projectile 1, the case 16 of the ammunition round 10 defines a chamber 20 which contains a main or primary propellant charge 22. At the base of the case 16 is supported an ignitor 24 and a control tube housing 26 holding a secondary propellant charge 28 which can be ignited by the ignitor 24.

Figure 2:
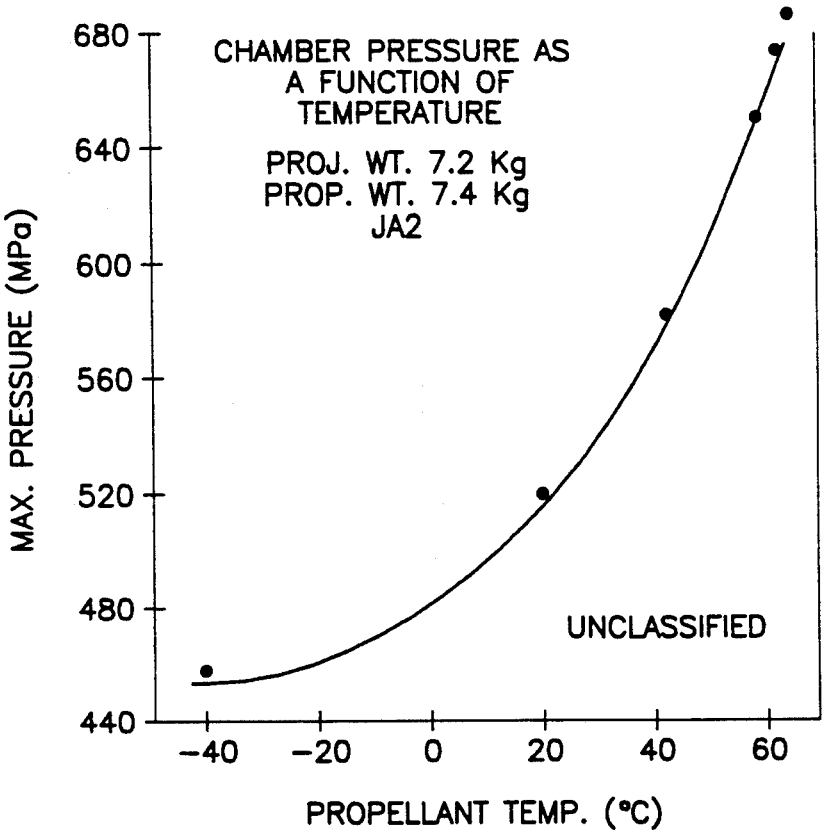
FIG. 2 is a graph depicting the relationship between variation in propellant chamber pressure as a function of propellant temperature for 120 mm kinetic energy ammunition.

The propellants typically used ar temperature dependent, that is, the burning rate of the propellant is a function of the temperature of the round. FIG. 2 shows the variation in the pressure produced in the ammunition round 10 as a function of temperature that is typical for 120 mm kinetic energy ammunition. Ordinarily, the highest chamber pressure is achieved at the maximum operational temperature limit of the ammunition. Therefore, at typical temperatures around 20 degrees C., the pressure is substantially lower. For example, for the one 120 mm cartridge, there is a net five percent loss in muzzle velocity at this temperature versus the velocity at the maximum temperature limit of 63 degrees C.

In the approach of the first patent application cross-referenced above, it is recognized that since the primary propellant charge for a given volume of the chamber provides greater average pressures behind the projectile as the temperature of the round increases, if the volume of the chamber is increased then the pressure is reduced, compensating for the higher temperature. The cross-referenced application proposes changing the rate of volume change of the chamber by adjusting the velocity of the projectile in the barrel. Adjusting the velocity of projectile is accomplished in the cross-referenced application by ignition of secondary propellant charge in the control tub which is itself temperature sensitive. The secondary propellant charge forces a piston down the control tube pushing the projectile at a higher velocity the higher the temperature which changes the rate of volume change of the chamber containing the primary propellant charge. Since the temperature of the secondary propellant charge is the same as the temperature of the ammunition round, it compensates for an increase in round temperature by creating a greater pressure and thereby applying an increased force to the piston to push the projectile faster forwardly in the barrel and further increase chamber volume.

The ammunition round 10 of the present invention incorporates a temperature compensating control system for adjusting the volume of the primary propellant chamber 20 of the ammunition round 10 in a different way than that of the first application cross-referenced above. A first embodiment of the control system, designated 30, is illustrated in FIGS. 1–4.

In its basic components, the control system 30 of the first embodiment include the control tube housing 26 and a piston assembly 32 slidably mounted relative to the housing 26 for movement through a drive stroke and being drivingly coupled to a final 8A on the trailing end of the projectile 18 for moving the latter as its moves through such drive stroke. Also, the control system 30 includes means responsive to the temperature of the ammunition round 10 for adjusting the length of the drive stroke of the piston assembly 32 in proportion to the temperature and thereby adjusting the position of the projectile 18 and volume of the chamber 20 in proportion to the temperature of the ammunition round 10.

More particularly, the piston assembly 32 of the control system 30 includes a piston 34 slidably mounted on the control tube housing 26 and having an arrangement of raised stair steps-like shoulders 36 defining a plurality of different stroke length defining elements or stops. The piston 34 is in the form of a hollow cylinder being mounted about the exterior of the control tube housing 26 for slidable movement therealong. A gas-venting orifice 38 is defined in the piston leading end 34A for providing communication with the interior of the control tube housing 26. There are two sets of paired shoulders or stops 36 formed at opposite circumferential locations on the interior of the piston 34.

Figure 3:
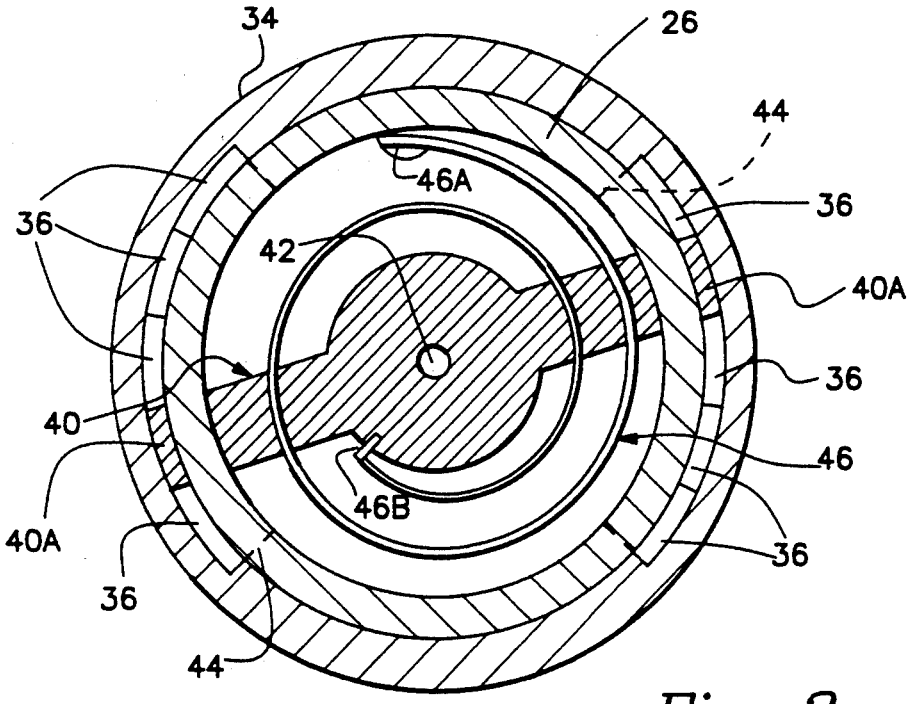
FIG. 3 is an enlarged cross-sectional view of the control system taken along line 3—3 of FIG. 1.

As seen in FIG. 3, means for adjusting the piston stroke length of the control system 30 includes the stroke length defining stops 36, and an elongated armature 40 of trapezoidal cross-sectional shape and pivotally mounted about a stationary central support 42 in the housing 26 and in transverse relation thereto. The armature 40 has outer abutments 40A at its opposite sides extending radially outward through short circumferential arcuate-shaped slots 44 formed in the housing 26 and beyond the exterior thereof into alignment with the stroke length defining stops 36 of the piston 34.

Rotation or pivotal movement of the armature 40 will place its opposite outer abutments 40A in alignment with different pairs of the piston stops 36 for adjusting the stroke length of the piston 34.

Also, the piston stroke length adjusting means of the control system 30 includes an arcuate element 46 responsive to temperature variation by changing its geometrical configuration to cause movement of the pivotal armature 40 to bring its outer abutments 40A into alignment with a given pair of the piston stops 36 for adjusting the stroke length of the piston assembly 32. The temperature variation responsive element 46 preferably is a bimetallic strip.

As seen in FIG. 3, the bimetallic strip element 46 has a spiral configuration, is attached at one end 46A to the housing 26 and connected at a opposite end 46B to the armature 40. The configuration of the bimetallic strip 46 is adapted to expand or contract in proportion to increase or decrease in the temperature of the ammunition round 10 and thereby cause movement of the armature 40 into alignment with different pairs of the piston stops 36 for increasing or decreasing the stroke length of the piston 34 and thereby compensating for increase or decrease in ammunition temperature.

As seen in FIG. 1, the piston assembly 32 of the control system 30 further includes means connected to the projectile 18 and connected to the piston 34 to move therewith for transmitting the driving energy of the piston 34 to the projectile to move the same and for absorbing energy to stop movement of the projectile 18 at the end of the drive stroke of the piston. In this first embodiment of the control system 30, the energy absorbing means of the piston assembly 32 is in the form of a hollow cylindrical extension sleeve 48 and a connector rod 50. The extension sleeve 48 of the energy absorbing means is rigidly mounted to the leading end 34A of the piston 34 and projects forwardly therefrom. The sleeve 48 has a plurality of circumferentially-spaced gas-venting orifices 52 defined therein adjacent the piston leading end 34A.

The connector rod 50 of the energy absorbing means is slidably mounted within the sleeve 48 and extends through a hole 54 in a leading end 48A of the sleeve. At its trailing end 50A, the connector rod 50 is slidably mounted in the sleeve 48 and releasably connected to the piston leading end 34A. Thus, the connector rod 50 is disposed in abutting relation with the piston 34 to move with the piston through its stroke and to close the gas-venting orifices 38, 52 in the piston leading end 34A and in the sleeve 48. At its leading end 50B, the connector rod 50 is detachably coupled to the trailing fin 18A of the projectile 18.

Figure 4A:
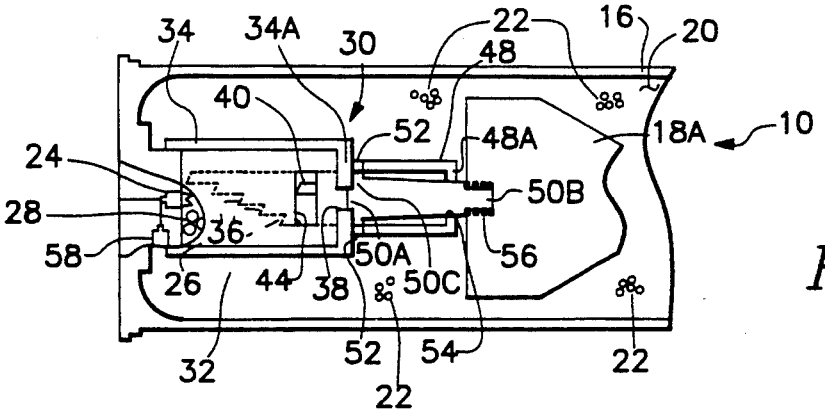
FIGS. 4A–4D are fragmentary views of the round of FIG. 1 at successive stages in temperature compensating adjustment of projectile location and thereby of propellant chamber volume by the features of the control system of the present invention prior to ignition of the main propellant charge.

Turning now to FIGS. 4A-4D, there is shown the components of the control system 30 in the ammunition round 10 at successive stages in temperature compensating adjustment of projectile location and thereby of propellant chamber volume leading up to ignition of the main propellant charge 22. As shown in FIG. 4A, the first event to occur is that a spark is delivered to the igniter 24, and that ignites a small amount of secondary propellant charge 28 residing in the control tube housing 26.

Figure 4B:
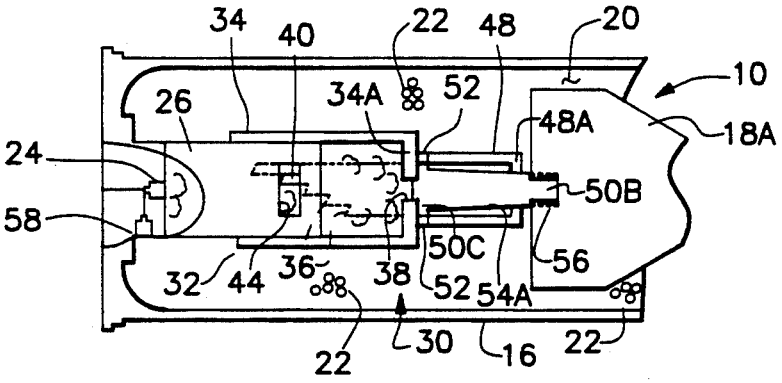

In FIG. 4B, the ignited secondary propellant charge 28 thrusts the piston 34 forwardly. The piston 34 is connected by the connector rod 50 to the fin 18A of the projectile 18, so the entire projectile is moved forward, increasing the free volume in the chamber 20. The piston 34 comes to a halt when given pair in its sets of stops 36 reach and contact the opposite ends of the armature 40 being aligned therewith and determining the length of the piston stroke.

Figure 4C:
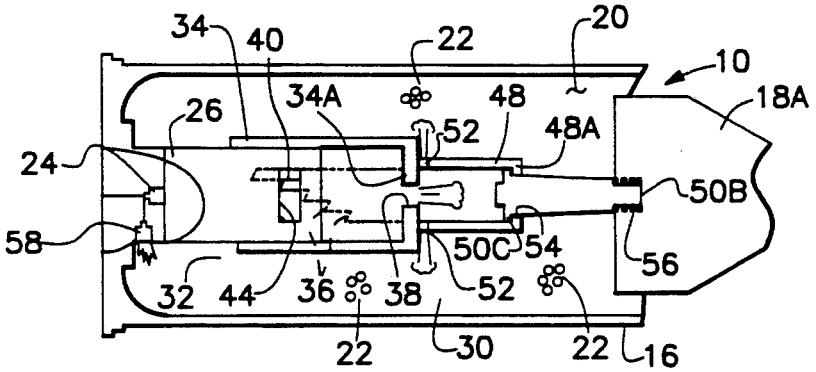

In FIG. 4C, the piston 34 has come to a full stop, but the projectile !8 has so much momentum it needs to be slowed down over a finite distance to prevent breaking any of the links in this mechanical chain. The connection to the fin 18A slows down by plastically deforming the leading end 48A of the sleeve as the tapered body of the connector rod 50 is forced through the hole 54 in the leading end 48A of the sleeve. This action, at the same time unplugs or disconnects the connector rod 50 from the piston leading end 34A, opening the orifice 38 and allowing secondary propellant gases inside the control tube housing 26 to vent into the main propellant charge 22 via the sleeve orifices 52. The projectile 18 is stopped when the connector rod flange 50C reaches the opposite end of the extension sleeve 48.

Figure 4D:
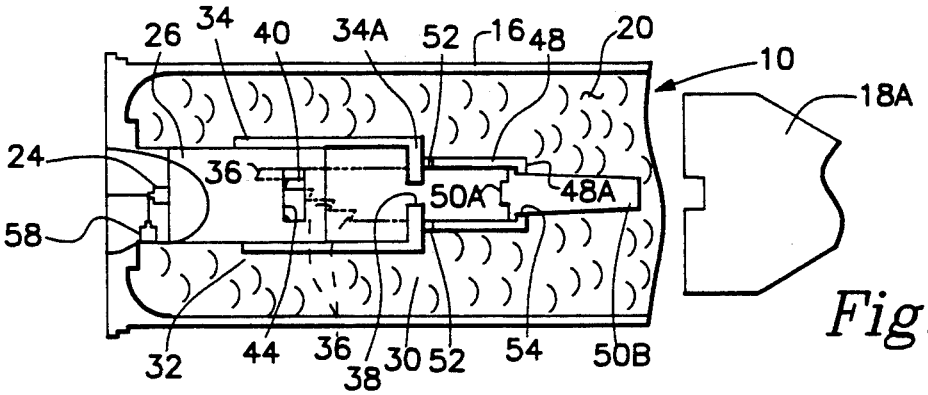

As shown in FIG. 4D, the secondary propellant gases ignite the main propellant charge 22. The burning of the main charge creates the pressure s high that it strips the threaded connection 56 between the connector rod 50 and the projectile fin 18A. The projectile 18 then moves on down the bore of the barrel 14 at high velocity.

FIG. 4C also shows that there is a redundant mechanism in the form of a secondary ignitor 58 for igniting the main charge 22 that occurs at the same time that the gases are vented. The secondary ignitor 58 is ignited after a built-in delay that allows enough time for the projectile !8 to stop. The secondary ignitor 58 is located in the main charge 22 and it give redundant assurance that the main charge 22 will ignite at the proper time.

Experiments have shown that the control system 30 will produce changes in chamber volume that lead to the desired temperature compensation. Velocities and pressures have been achieved that are just as high at 21 degrees C. as at temperatures of 49 degrees C. The control system 30 is believed to provide a more reliable pressure and velocity response than competitive temperature compensation approaches. The control system eliminates variation in performance with natural ignition time and bore friction variations. The system allows the ammunition to operate at the maximum allowable pressure and velocity across the temperature range.

A second embodiment of the temperature compensating control system, designated 60, is illustrated in FIGS. 5-11. In its basic components and mode of operation, the control system 60 of the second embodiment is substantially similar to the first embodiment just described with reference to FIGS. 1-4. The differences between the two embodiments will be pointed out.

Briefly described, the control system 60 includes a control tube housing 62, a piston assembly 64 slidably mounted relative to the housing 62 for movement through a drive stroke and coupled to the projectile 18 for changing the position of the projectile, and means responsive to the temperature of the round for adjusting the length of the piston drive stroke in proportion to the temperature and thereby the position of the projectile and volume of the chamber in proportion to the temperature of the round. The piston assembly stroke length defining means includes a plurality of different stroke length defining stops 66, an armature 68 pivotally mounted to the housing 62 for adjusting the stroke length of the piston assembly 64 by being aligned with one pair of the different stops 66, and a bimetallic strip 70. As before, the bimetallic strip 70 response to temperature variation by changing its geometry in proportion to the temperature variation of the round to cause pivoting of the armature 68 into alignment with different pairs of the piston stops 66 for adjusting the piston assembly stroke length and thereby compensating for temperature variation.

Several differences of the second embodiment from the first embodiment reside in the construction of the piston assembly 64. The piston assembly 64 includes a piston 72 is in the form of a hollow cylinder mounted in the interior housing 62 for slidable movement along the bore 62A therethrough. The pairs of different stroke length defining stops 66 are defined on the exterior of the piston 72. Another difference is that the energy absorbing means of the second embodiment is a connector rod 74 slidably mounted with a central bore 72A of the piston 72. The piston 72 also has a solid plug 76 threaded therein against which a trailing end of the connector rod 74 abuts through an 0-ring 78 therebetween such that the connector rod 74 moves with the piston 72 through its drive stroke. The leading end of the connector rod 74 detachably connects to the trailing end of the projectile. The piston 72 has opposite grooves 80 on the exterior thereof which are guided by keys 82 of an annular plate 84 fitted in the leading end of the housing 62 to prevent rotation of the piston 72.

The arrangement of the armature 68 and bimetallic strip 70 in the control assembly 60 of the second embodiment are substantially the same as in the control assembly 30 of the first embodiment. A retainer assembly 86 rotatably or pivotally mounts the armature 68 and disposes the strip 70 in the leading end of the housing 62. The strip 70 is connected at one end to the armature 68 and the opposite end to the housing 62. However, the armature 68 have abutments 68A thereon which extend radially inward into the housing bore 62A.

Figure 5:
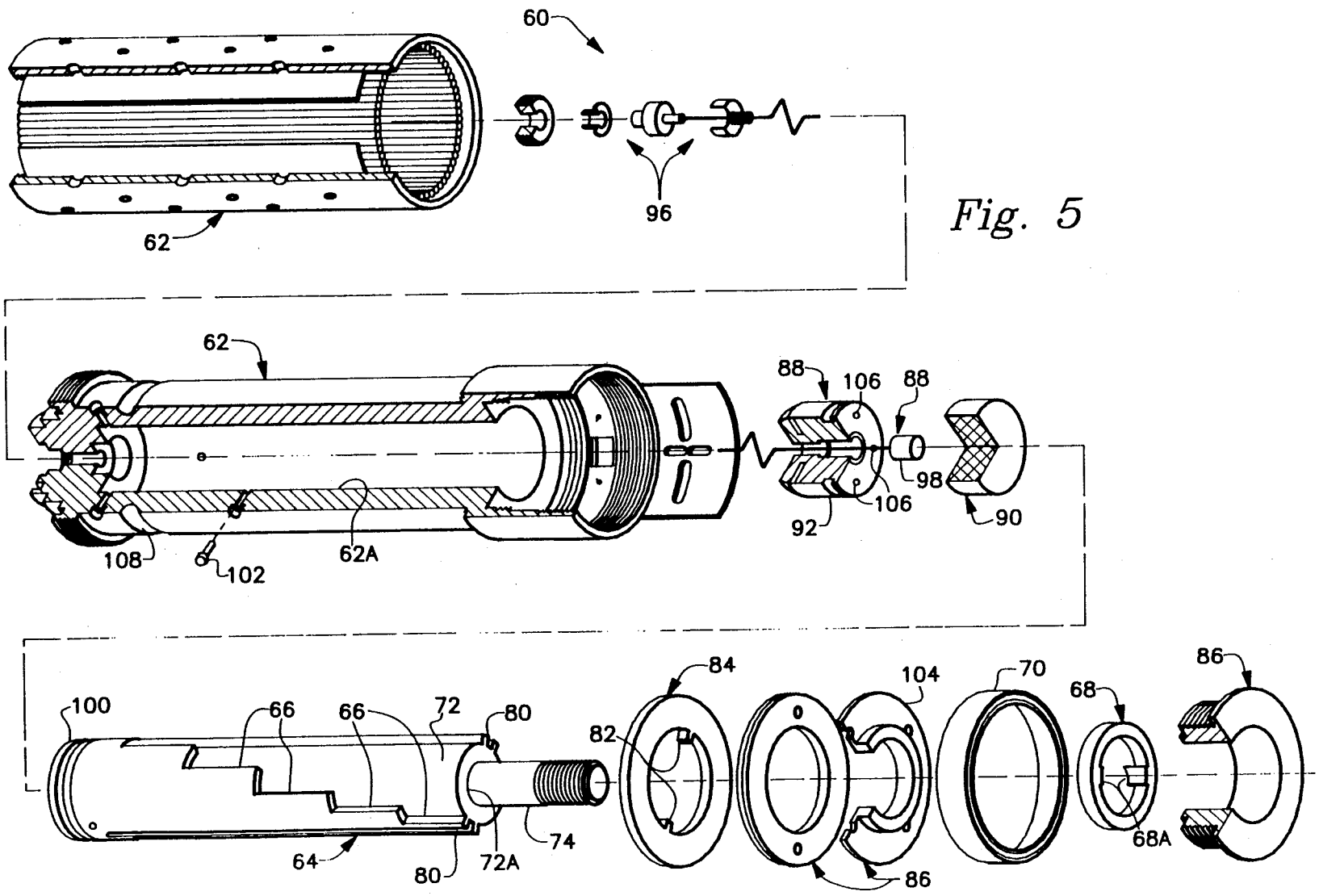
FIG. 5 is an exploded perspective view of a second embodiment of the temperature compensating control system of the present invention along with the ignitor and secondary propellant for the round.
Figure 9:
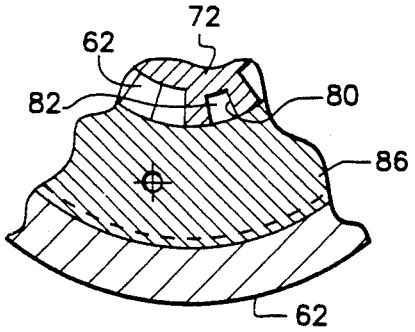
FIG. 9 is an enlarged fragmentary cross-sectional view taken along line 9—9 of FIG. 8.
Figure 10:
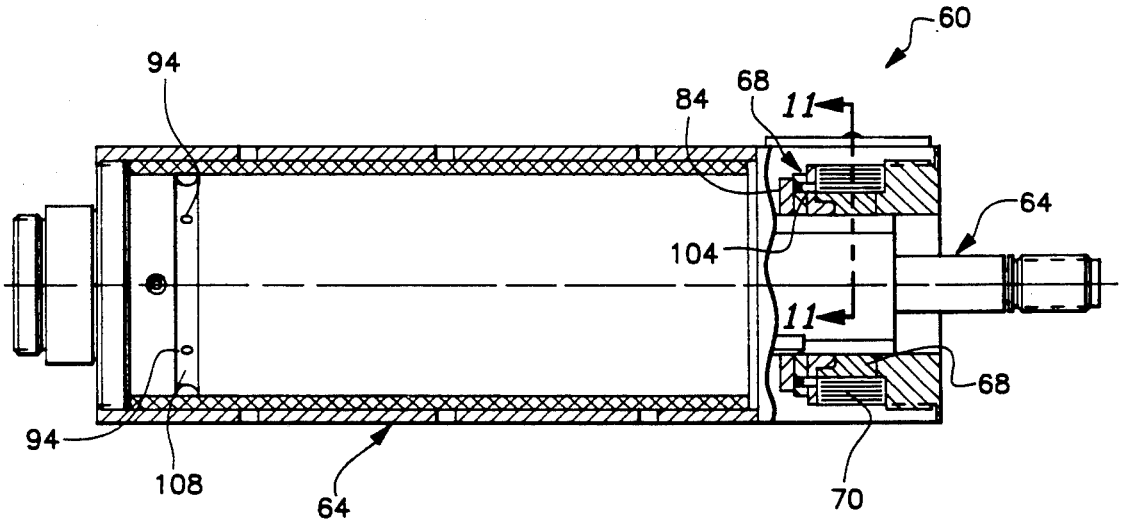
FIG. 10 is a side elevational view, partly broken away and axially sectioned, of the control tube housing, piston assembly and the piston assembly stroke length adjusting components of the control system of FIG. 5 assembled together.
Figure 11:
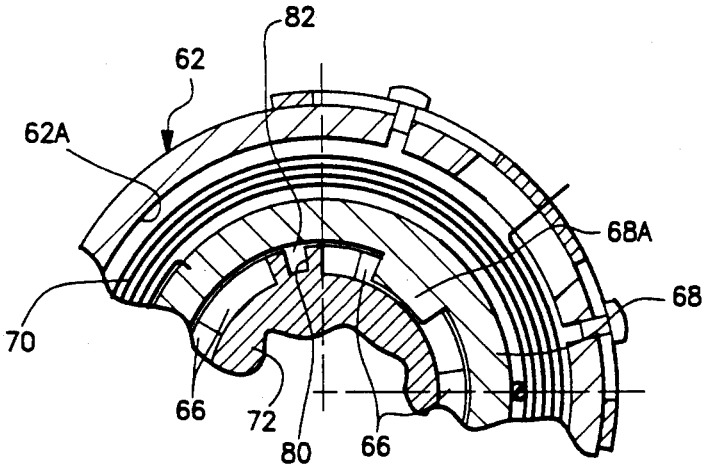
FIG. 11 is an enlarged fragmentary cross-sectional view taken along line 11—11 of FIG. 10.

Another difference of the second embodiment from the first embodiment is that the gas-venting orifices 38, 52 in the piston 34 and sleeve 48 of the first embodiment are not employed in the second embodiment. Instead, as seen in FIGS. 5, 6 and 8, an ignitor 88 is used for this purpose in the leading end of the control tube housing 62 adjacent and upstream of a secondary propellant charge 90 disposed adjacent the trailing end end of the piston 72. The ignitor 88 includes a delay block 92 having pyrotechnic delays aligned with in vent portions 92A which match with analogous ports 94 in the housing 62 to permit gases to emigrate through to the primary charge.

To operate the control assembly 60 of the second embodiment, an electrical impulse from a firing pin of the gun system is sent to the control tube housing 62 via an electrode assembly 96 seen in FIGS. 5 and 6. The current path then proceeds from the electrode assembly 96 to an ignition element 98 contained in the delay block 92 of the ignitor 88. The ignition element 98 contains a small black powder charge that is ignited through a resistive heating process. This is accomplished by running the electrical current across a sputtered bridge internal to the ignition element 98. The black powder charge then detonates which is the first phase in the ignition train. It should be noted that the ignition element 98 is press fitted into the delay block 92 which also houses the pyrotechnic delays.

The phase in the ignition train is the ignition of the secondary propellant charge 90 loaded forward of the delay block 92. Upon detonation of the black powder charge in the ignition element 98, the hot gases generated through combustion ignite the secondary propellant charge 90. The pressures generated through the combustion of this propellant charge acts as the principle driver in generating the thrust forces necessary to push the projectile up the gun tube bore to its desired location.

This gas pressure acts on the upstream or aft end of the piston 72 which is also equipped with an O-ring 100 that functions in restraining the high pressure gases from leaking by. It should also be noted that the piston 72 is locked to the control tube housing 62 by a set screw 102. As pressure builds up to around 100 psi, this screw 102 fails in shear thereby releasing the piston 72. A pressure of 10,000 psi is generated through this combustion process that acts on one square inch of piston area. This equates to 10,000 pounds of thrust force that is available for positioning the projectile.

The projectile mass is driven by the piston assembly 64 that, as described above, provides the mechanical threaded link to the fin of the projectile, same as in the first embodiment. The piston assembly 64 includes the piston 72, connector rod 74 and plug 76. The plug 76 which is threaded into the piston 72 is the member assuming all of the bearing load since it distributes the accelerative force to the connector rod 74 (via the O-ring 78) and subsequently to the projectile.

The positioning of the projectile mass is controlled by the temperature compensating bimetallic element or spring 70. The bimetallic spring 70 is assembled to the armature 68 which is the arresting or stopping mechanism of the control assembly 60. The armature 68 rotates about a low friction bushing 104 of the retainer assembly 86. Based on temperature increases or decreases, the bimetallic spring 70 will either expand or contract, thereby imputing rotational motion to the armature 68. By way of example, the bimetallic spring 70 is designed to provide work between the temperatures of 21 to 49 degrees C. Additionally, this work is performed over 144 angular degrees of rotation, or 4.9 angular degrees of rotation per degree C. of temperature change.

The positioning of the projectile mass is accomplished by means of the abutments 68A on the armature 68 locking off on one of the pairs of stops 66 on the piston 72. The piston 72 is driven up the housing bore 62A and locks upon at a pair of its stops 66 on the armature abutments 68A. The keying of the piston 72 on the annular key plate 84 permits linear motion of the piston but eliminates any possibility of rotation thereof. Upon impact, the armature 68 is driven up against the end of the retainer assembly 86 that ultimately retains all of the components in place.

During the process of positioning the projectile mass to its correct location, another process is being initiated in the ignition train. The functioning of the primary propellant charge (not shown) which surrounds the control tube housing 62 occurs through a mechanical delay built into the delay block 92. A group of four pyrotechnic delays that are press fitted into the delay block 92 form the delay to igniting the primary charge. The pyrotechnic delays are characterized by a burn rate of 0.175 seconds per inch of length. A delay cord length of approximately 0.115 inches allows for a burn through of approximately 20 milliseconds.

The pyrotechnic delays 106 are positioned in the delay block 92 such that they are exposed at one end to the hot gases from the secondary propellant charge in 90. At their opposite end, the delays 106 are alignment with the vent portions 92A which match with analogous ports 94 in the housing 62. Once exposed to the hot gases, the pyrotechnic delays 106 are ignited and burn through in approximately the 20 millisecond time frame mentioned previously. The vent portions 92A of the delay block 92 extend beneath the delays 106 and then turn radially outward therefrom to match up with the ports 94 of the control tube housing 62 which are interconnected by a manifold depression 108 formed in the housing exterior. Once the pyrotechnic delays 106 have burned through, the secondary propellant gases are free to escape through the delay block 92 and exterior to the housing 62 and ultimately to the primary propellant charge to ignite the same and launch the projectile from its adjusted position.

It is thought that the present invention and many of its attendant advantages will be understood from the foregoing description and it will be apparent that various changes may be made in the form, construction and arrangement of the parts thereof without departing from the spirit and scope of the invention or sacrificing all of its material advantages, the form hereinbefore described being merely a preferred or exemplary embodiment thereof.

Having thus described the invention, what is claimed is:

1. A temperature compensating control system for adjusting the volume of a chamber in an ammunition round which communicates with a projectile and contains a propellant having temperature dependent performance characteristics, said control system comprising:

(a) a control tube housing;

(b) a piston assembly slidably mounted relative to said housing for movement through a drive stroke and being drivingly coupled to a trailing end of the projectile; and (c) means responsive to the temperature of the ammunition round for adjusting the length of the drive stroke of said piston assembly in proportion to the temperature and thereby adjusting the position of the projectile and said volume of the chamber in proportion to the temperature of the ammunition round; and (d) means for stopping the piston in response to the temperature of the ammunition round at an adjusted position prior to firing the round.

2. A temperature compensating control system for adjusting the volume of a chamber in an ammunition round which communicates with a projectile and contains a propellant having temperature dependent performance characteristics, said control system comprising:

(a) a control tube housing;

(b) a piston assembly slidably mounted relative to said housing for movement through a drive stroke and being drivingly coupled to a trailing end of the projectile having a plurality of different stroke length defining stops formed on said piston assembly;

(c) means responsive to the temperature of the ammunition round for adjusting the length of the drive stroke of said piston assembly in proportion to the temperature and thereby adjusting the position of the projectile and said volume of the chamber in proportion to the temperature of the ammunition round; and, (d) an armature movably mounted in said housing and having at least one abutment being alignable with one of said different stops for adjusting the stroke length of said piston assembly.

3. The control system of claim 2 wherein said piston stroke length adjusting means also includes an element responsive to temperature variation by changing its geometrical configuration to cause movement of said armature into alignment with a given one of said piston assembly stops for adjusting the stroke length of said piston assembly.

4. The control system of claim 3 wherein said temperature variation responsive element is a bimetallic strip.

5. The control system of claim 4 wherein said bimetallic strip has a spiral configuration, and is attached at one end to said housing and connected at an opposite end to said armature.

6. The control system of claim 4 wherein said bimetallic strip has a configuration for expansion or contraction in proportion to increase or decrease in the temperature of the ammunition round and thereby cause movement of said armature into alignment with different ones of said piston stops for increasing or decreasing the stroke length of said piston assembly and thereby compensating for increase or decrease in temperature.

7. The control system of claim 2 wherein:

said piston assembly includes a piston being slidably mounted to the exterior of said housing;

said stops are formed on the interior of said piston; and said armature is rotatably mounted to said housing with said abutment of said armature extending radially outward through a slot in said housing and beyond the exterior thereof into alignment with one of said stops.

8. The control system of claim 2 wherein:

said piston assembly includes a piston being slidably mounted to the interior of said housing;

said stops are formed on the exterior of said piston; and said armature is rotatably mounted to said housing with said abutment of said armature extending radially inward into the interior of said housing and into alignment with one of said stops.

9. A temperature compensating control system for adjusting the volume of a chamber in an ammunition round which communicates with a projectile and contains a propellant having temperature dependent performance characteristics, said control system comprising:

(a) a control tube housing;

(b) a piston assembly having a piston slidably mounted relative to said housing for movement through a drive stroke and being drivingly coupled to a trailing end of the projecting;

(c) energy absorbing means connected to the projectile and mounted to said piston to move therewith for transmitting the driving energy of said piston to the projectile to move the same and for absorbing energy to stop movement of the projectile at the end of said drive stroke of said piston wherein the energy absorbing means includes:

a hollow extension sleeve connected at a leading end of said piston and projecting forwardly therefrom; and a connector rod releasably connected at a leading end to the projectile and slidably mounted at a trailing end in said sleeve and in abutting relation with said piston to move therewith through its stroke; and (d) means responsive to the temperature of the ammunition round for adjusting the length of the drive stroke of said piston assembly in proportion to the temperature and thereby adjusting the position of the projectile and said volume of the chamber in proportion to the temperature of the ammunition round.

10. The control system of claim 9 wherein:

said leading end of said piston has a gas-venting orifice defined therethrough in communication with the interior of said control tube housing; and said sleeve communicates with said piston orifice and has a plurality of gas-venting orifices defined therein adjacent said leading end of said piston.

11. The control system of claim 10 wherein said connector rod at its trailing end is releasably connected to said leading end of said piston so as to close said gas-venting orifices in said piston leading end and said sleeve, said connector at its leading end being detachably coupled to the trailing end of the projectile such that inertia of the projectile as caused by piston movement, in turn, causes said connector to release from said piston leading end and open said orifices to allow venting of secondary propellantgenerated gases from within said control tube housing to the propellant in the chamber for igniting the same.

12. The control system of claim 9 wherein:

said piston is in the form of a hollow cylinder mounted within the interior of said control tube for slidable movement therealong; and said energy absorbing means is a connector rod releasably connected at a leading end to the projectile and slidably mounted at a trailing end in said piston and in abutting relation therewith to move with said piston through its stroke.

13. In an ammunition round having a chamber, a projectile which communicates with said chamber and a propellant contained in said chamber having temperature dependent performance characteristics, a temperature compensating control system for adjusting the volume of said chamber, comprising:

(a) a control tube housing disposed in said chamber;

(b) a piston assembly including a piston slidably mounted to the housing for movement relative thereto through a drive stroke, said piston assembly being drivingly coupled to a trailing end of said projectile, said piston having a plurality of pairs of different stroke length defining elements formed thereon; and (c) means responsive to the temperature of said ammunition round for adjusting the length of the drive stroke of said piston assembly in proportion to the temperature and thereby adjusting the position of said projectile and said volume of said chamber in proportion to the temperature of said ammunition round.

14. The control system of claim 13 wherein said piston stroke length adjusting means includes an armature pivotally mounted to said housing and having a pair of abutments being alignable with one of said pairs of different stroke length defining elements for adjusting the stroke length of said piston assembly.

15. The control system of claim 14 wherein said piston stroke length adjusting means also includes an element responsive to temperature variation by changing its geometrical configuration to cause pivotal movement of said armature to dispose its abutments in alignment with a given one of said paris of different stroke length defining elements for adjusting the stroke length of said piston assembly.

16. The control system of claim 15 wherein said temperature variation responsive element is a bimetallic strip.

17. The control system of claim 16 wherein said bimetallic strip has a spiral configuration, and is attached at one end to said housing and connected at an opposite end to said armature.

18. The control system of claim 16 wherein said bimetallic strip has a configuration for expansion or contraction in proportion to increase or decrease in the temperature of the ammunition round and thereby cause movement of said armature to dispose its pair of abutments into alignment with different ones of said pairs of stroke length defining elements for increasing or decreasing the stroke length of said piston assembly and thereby compensating for increase or decrease in temperature.

19. The control system of claim 14 wherein:

said piston of said piston assembly is slidably mounted to the exterior of said housing;

said pairs of different stroke length defining elements are pairs of stops in the form of recessed shoulders formed on the interior of said piston; and said armature is rotatably mounted to said housing with said abutments of said armature extending radially outward through a slot in said housing and beyond the exterior thereof into alignment with one of said pairs of stops.

20. The control system of claim 14 wherein:

said piston of said piston assembly is slidably mounted to the interior of said housing;

said pairs of different stroke length defining elements are pairs of stops in the form of recessed shoulders formed on the exterior of said piston; and said armature is rotatably mounted to said housing with said abutments of said armature extending radially inward into the interior of said housing and into alignment with one of said pairs of stops.

21. The control system of claim 13 wherein said piston assembly further includes means connected to the projectile and mounted to said piston to move therewith for transmitting the driving energy of said piston to the projectile to move the same and for absorbing energy to stop movement of the projectile at the end of said drive stroke of said piston.

22. The control system of claim 21 wherein said energy absorbing means includes:

a hollow extension sleeve connected at a leading end of said piston and projecting forwardly therefrom; and a connector rod releasably connected at a leading end to the projectile and slidably mounted at a trailing end in said sleeve and in abutting relation with said piston to move therewith through its stroke.

23. The control system of claim 21 wherein:

said piston is in the form of a hollow cylinder mounted within the interior of said control tube for slidable movement therealong; and said energy absorbing means is a connector rod releasably connected at a leading end to the projectile and slidably mounted at a trailing end in said piston and in abutting relation therewith to move with said piston through its stroke.

* * * * *

UNITED STATES PATENT AND TRADEMARK OFFICE

CERTIFICATE OF CORRECTION

PATENT NO. : 5,062,366

DATED : November 5, 1991

INVENTOR(S) : Calvin T. Candland

It is certified that error appears in the above-identified patent and that said Letters Patent is hereby corrected as shown below:

Column 1, line 4, after the title insert the following paragraph;

--This invention was made with Government support under Contract No. DAAK11-84-C-0102 awarded by the Department of the Army. The Government has certain rights in this invention.--

Signed and Sealed this

Thirtieth Day of March, 1993

*Attest:*

STEPHEN G. KUNIN

*Attesting Officer*

*Acting Commissioner of Patents and Trademarks*